US006354231B1

(12) United States Patent
Morris

(10) Patent No.: US 6,354,231 B1
(45) Date of Patent: Mar. 12, 2002

(54) TABLE LEG WITH HEIGHT-ADJUSTING SPACER

(75) Inventor: John F. Morris, Nashville, TN (US)

(73) Assignee: Anderson Hickey Company, Nashville, TN (US)

( * ) Notice: Subject to any disclaimer, the term of this patent is extended or adjusted under 35 U.S.C. 154(b) by 0 days.

(21) Appl. No.: 09/457,220

(22) Filed: Dec. 8, 1999

(51) Int. Cl.[7] ..... A47B 9/00

(52) U.S. Cl. ..... 108/144.11; 108/147.19; 248/188.4

(58) Field of Search ..... 108/144.11, 147.19, 108/64; 248/188.4, 188.8

(56) References Cited

U.S. PATENT DOCUMENTS 3,150,853 A * 9/1964 Lisbin ..... 248/188.4 X
3,329,105 A * 7/1967 McPherson ..... 108/144.11 X
3,722,565 A * 3/1973 Miller, Jr. et al. .... 248/188.4 X
4,789,121 A * 12/1988 Gidseg et al. ..... 248/188.4 X
5,142,734 A * 9/1992 Looman et al. ..... 248/188.4 X
5,881,979 A * 3/1999 Rozier, Jr. et al. .... 248/188.4 X

FOREIGN PATENT DOCUMENTS

GB 390 * 1/1901 ..... 248/188.4 X

* cited by examiner

*Primary Examiner*—Peter M. Cuomo
*Assistant Examiner*—Michael J. Fisher
(74) *Attorney, Agent, or Firm*—Flynn, Thiel, Boutell & Tanis, P.C.

(57) ABSTRACT

A table leg supporting a table top vertically above the floor is adjustable between minimum and maximum heights and adapted to receive a castor at the lower end thereof. The castor alters the minimum height of the table leg to be greater than the maximum height of the table leg without the castor. A spacer is removably mounted on the lower end of the table leg without a castor for increasing its height to be at least equal to and preferably greater than the minimum height of the table leg with a castor. Thus, tables supported by legs with castors can be positioned adjacent tables supported by legs without castors, and the adjacent tables can be adjusted to the same height by adding spacers to the non-castored legs.

12 Claims, 5 Drawing Sheets

TABLE LEG WITH HEIGHT-ADJUSTING SPACER

FIELD OF THE INVENTION

This invention relates to a table leg for supporting a table top above a floor, and more particularly to a table leg with a height-adjusting spacer.

BACKGROUND OF THE INVENTION

To improve the ergonomics of tables, some include table legs that have adjustment mechanisms so that the length of the leg, and hence height of the table above the floor, can be adjusted. Such height adjustment mechanisms typically include a foot threadedly received on the table leg so that the foot can be rotated to determine the length of the leg. The length adjustment capability, however, is typically of a small extent.

Some table legs also mount a castor at the floor-engaging end thereof so that the mobility of the table is improved. The addition of castors to table legs increases the length of the table leg and hence the height of the table above the floor. In an effort to improve the ergonomics of the table legs with castors, it is conventional to mount the castor on the above-described foot so that the length of the castored table leg can be adjusted. However, the addition of a castor significantly increases the length of the table leg to such an extent that the minimum length adjustment of a castored table leg is greater than the maximum length of a castor-free table leg. Thus, two of the same type of tables, one supported by castored table legs and the other supported by castor-free table legs, can not be used adjacent each other to create a single height worksurface because of these differing leg lengths prevent the table worksurfaces from being disposed in an aligned and planar relationship.

It is desirable in today's modular office environments to allow different arrangements of tables so that use of the tables and the worksurfaces that they provide is maximized. It follows that the user desires the ability to move tables supported by castored legs into position adjacent tables supported by castor-free legs, and thus use the adjacent tables as a contiguous planar worksurface without a protruding ledge at the joint between the adjacent tables.

Some tables are also supported by noncastored legs at one end and castored legs at the other end. Unfortunately, these tables often require the use of different legs so as to accommodate the castors at one end.

It is also desirable in today's office environment to be able to modify (i.e. retrofit) a table leg to provide it either with or without a castor, while at the same time permitting use of the table at the same height. Such is not possible with some conventional tables.

Accordingly, it is an object of the present invention to provide a structure for compensating for the differing minimum height (axial length) of a table leg with a castor (i.e. castored leg) and the maximum height of a table leg without a castor (i.e. castor-free leg) so that castor-free legs and castored legs can have the same length.

More specifically, it is an object of the present invention to provide a removable spacer on a castor-free table leg so that the maximum leg length is at least as long as the minimum length of a castored table leg. The maximum length of the table leg with spacer of the present invention is preferably at least somewhat greater than the minimum length of a castored table leg.

Other objects and purposes of the present invention will be apparent to persons familiar with structures of this general type upon reading the following specification and inspecting the accompanying drawings.

Figure 1:
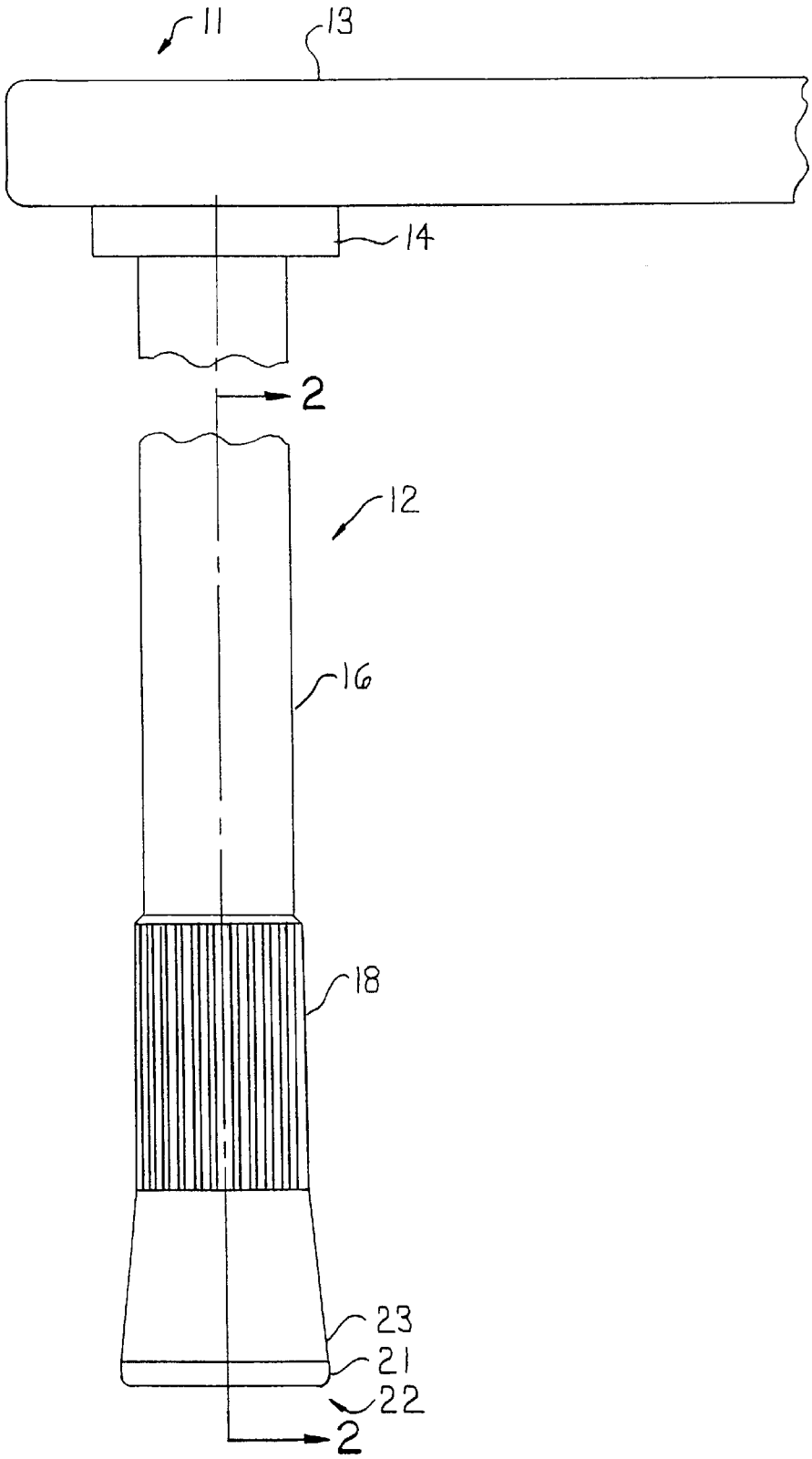
FIG. 1 is a fragmentary, elevational side view of a table top and table leg.

Certain terminology will be used in the following description for convenience in reference only, and will not be limiting. For example, the words "upwardly", "downwardly", "rightwardly" and "leftwardly" will refer to directions in the drawings to which reference is made. Said terms will also refer to the conventional orientation of the leg structure during use thereof. The words "inwardly" and "outwardly" will refer to directions toward and away from, respectively, the geometric center of the table leg and designated parts thereof. Said terminology will include the words specifically mentioned, derivatives thereof, and words of similar import.

DETAILED DESCRIPTION

Figure 2:
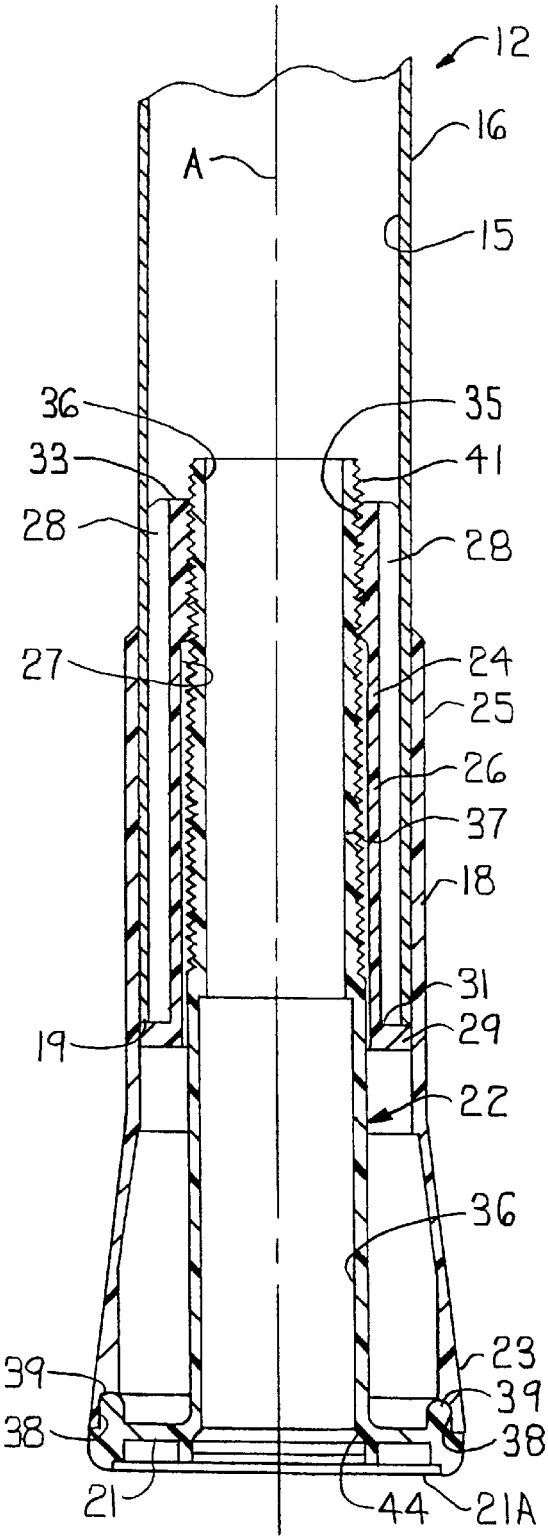
FIG. 2 is an enlarged cross sectional view taken generally along line 2—2 in FIG. 1.

Referring to the drawings, FIGS. 1 and 2 illustrate a table 11 supported vertically from a floor (not designated) by a leg structure 12 which is joined to the underside of the table top 13 by a conventional connector 14. The leg structure 12 includes an elongate main leg 16 depending downwardly from and at its upper end connecting to the connector 14, a decorative outboard sleeve 18 slidingly partially telescoping over a lower end 19 of the leg 16, a mounting bushing 24 fixed in the lower leg end 19, and an adjustable glide 22 movably mounted in the bushing 24 and projecting downwardly from the lower leg end 19. The adjustable glide 22 conventionally rests on the floor.

The elongate main leg 16 is a hollow cylindrical tube defining a longitudinal through passage 15. The leg 16 is normally oriented so that the longitudinal axis A thereof projects substantially vertically. The lower portion of the passage 15 receives the bushing 24, whereas the upper end is closed by the table top 13 or the connector 14.

The bushing 24 (FIGS. 2 and 4) is received in the lower portion of the leg passage 15 and fixed to the lower end 19 of the leg 16. The bushing 24 comprises an elongate, rigid right cylindrical tube 26 enclosing a coaxial through passage 27. A plurality of angularly spaced, axially extending ribs 28 project radially outwardly from the tube 26. The tube 26 at its lower end terminates in an annular outboard flange 29. The flange 29 has a outer diameter generally equal to the outer diameter of the main leg 16 and abuts the lower free leg end 19. The plurality of outboard, radially extending ribs 28 are positioned on the tube 26 extending axially from the annular flange 29 to an upper end 33 of the tube 26 and define an outer diameter generally equal to the diameter of the passage 15 so as to effect a snug fit of the bushing 24 within the leg 16.

Figure 4:
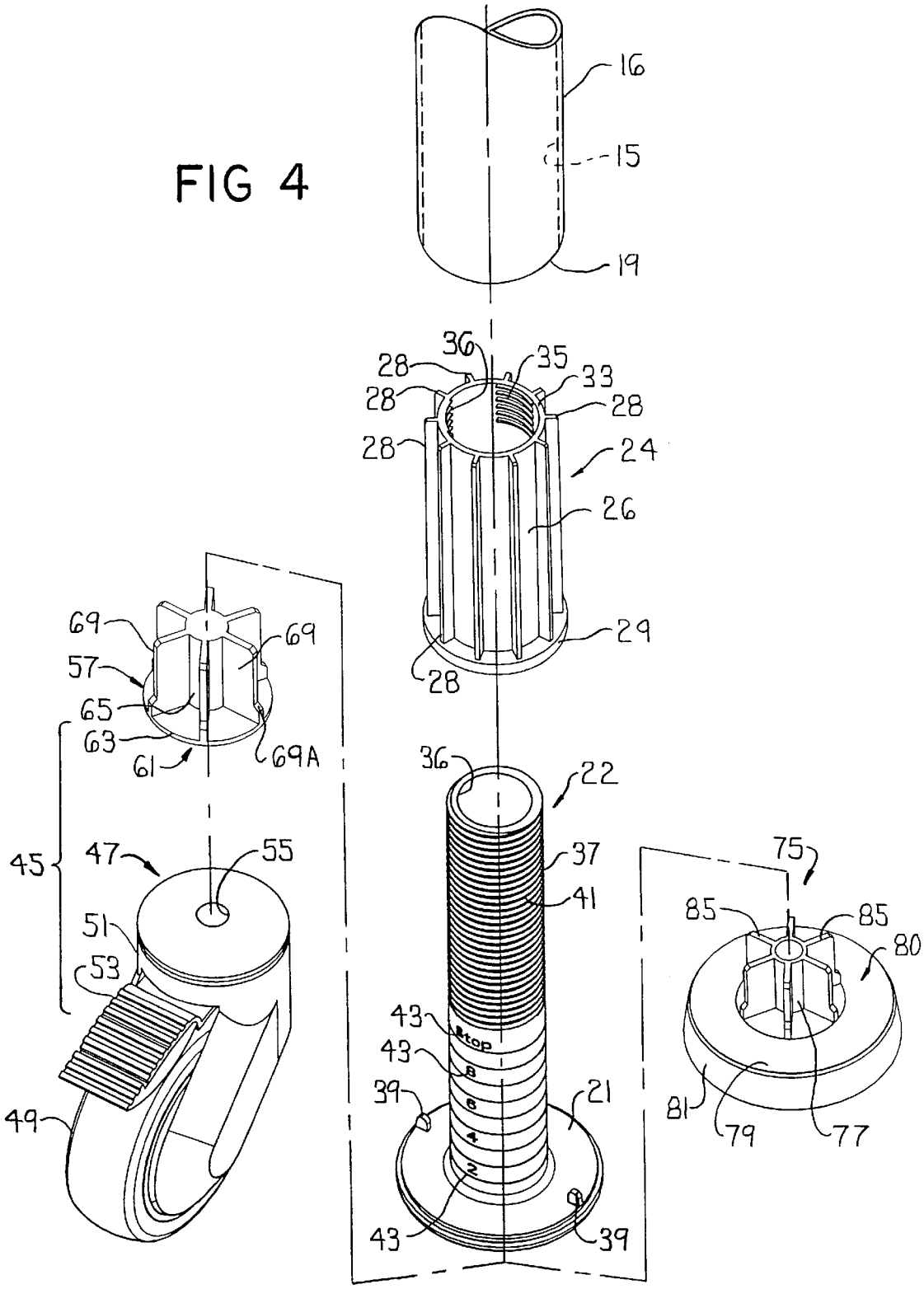
FIG. 4 is an exploded view of a table leg showing two alternative attachments.

As shown in FIGS. 2 and 4, internal threads 35 are positioned in the passage 27 of tube 26 solely adjacent the upper end 33 thereof. The threads 35 in the illustrated arrangement extend partially longitudinally, e.g. less than one-third of the length of the tube 26, and the remainder of the passage 27 is substantially smooth-walled and of greater diameter than the thread diameter.

The bushing 24 is preferably constructed of a relatively hard and strong plastics material.

The adjustable glide 22 includes an elongate, rigid generally right cylinder 37 enclosing a through passage 36, and a radially outwardly projecting annular flange 21 at the lower end of the cylinder 37. The flange 21, which functions as a floor-engaging foot, includes at least two upward nubs 39 which cooperate with the decorative sleeve 18 as explained hereinafter. The nubs 39 can be replaced with an annular rib (not shown) on the upper surface of the flange 21 if desired. The nubs 39 are disposed closely adjacent but slightly radially inwardly of the exterior peripheral surface 40 of the flange 21. The flange 21 also defines thereon a lower or bottom surface 21A which can directly contact the floor.

The cylinder 37 has external threads 41 beginning at the upper end thereof and extending over about one-half the length thereof. The axial length of the threaded section 41 is, in the preferred arrangement, of a length similar to the length of the bushing 24. From the lower end of the threads 41 to the flange 21, the cylinder 37 is non-threaded but includes indicia 43 which indicate the extent that the adjustable glide 22 projects downwardly beyond the lower end 19 of the main leg 16. As shown in FIG. 4, the indicia 43 include visible circumferential markers and length indicators which are embossed or otherwise applied on the outer surface of the cylinder so that they are visible to a person adjusting the length of the leg structure 12. The indica 43 may be surrounding lines which in effect define a plurality of axially adjacent annular bands containing visual indicators such as numbers.

The lower end of the glide 22 defines therein a component-receiving opening or recess 44 which opens coaxially upwardly from the bottom of the foot 21 for communication with the passage 35. This recess is generally cylindrical, but is stepped radially inwardly where it joins to the passage 35.

Considering now the cover or sleeve 18, it includes an upper tube part 25 integral with an outwardly flared, downwardly depending annular skirt part 23. The tube 25 has an inner diameter slightly greater than the outer diameter of the leg 16 so that the sleeve 18 is slidably but snugly received over the leg. The skirt 23 at its lower free end includes an internal annular recess 38 in which the nubs 39 are received so as to axially secure the skirt to the glide 22 with the skirt resting on top of the flange 21 in its lowered position. The skirt 23 has a maximum diameter substantially equal to the diameter of the flange 21. Thus, in a lowered position of the sleeve 18, it substantially encloses the glide 22 irrespective of the adjusted position thereof.

In the assembly of the leg structure 12, the bushing 24 is received in the lower end of the through passage 15 of the main leg 16 until the flange 29 abuts the lower face of the leg 16 so as to limit axial insertion of the bushing. The ribs 28 of the bushing 24 press against the surface of the passage 15 to fix the bushing 24 within the leg 16. The decorative sleeve 18 is telescoped over the exterior of the leg 16 and flange 29. Thereafter, the cylinder 37 of the adjustable glide 22 is axially inserted into the through passage 27 of the bushing 24 until its external threads 41 contact the internal threads 35 of the bushing 24. The adjustable glide 22 is rotated so that the threads 35, 41 intermesh and thereby adjustably fix the glide in the bushing 24. The main leg 26, bushing 24, and adjustable glide 22 thus nest within each other in the assembled state of the leg structure 12.

The assembled leg structure 12 has a maximum length H2 (FIG. 6) when the adjustable glide 22 is threaded axially downwardly (away from table 11) to its maximum extent wherein all of the threads 35 of the bushing 24 fully intermesh with threads 41 of the glide 22. The threads 35 of the bushing 24 are always fully intermeshed in the threads 41 of the cylinder 37 for safety considerations. This maximum height H2 corresponds to a position with the "stop" indicia 43 visible as shown in FIG. 4. During adjustment of the height of the leg structure 12, the decorative sleeve 18 can be slid axially upwardly of the main leg 16 so that the indicia 43 are visible to the person adjusting the leg height. After the desired height is reached, the decorative sleeve 18 is slid downwardly onto the flange 21 of the glide 22 and covers the indicia 43 and the portion of the glide cylinder 37 extending downwardly below the lower end of the leg 16.

In one construction of the leg structure 12, a castor assembly 45 (FIGS. 3 and 4) is mounted to the lower end of the adjustable glide 22. The castor assembly 45 includes a conventional castor 47 having a wheel 49 mounted to a yoke 51 by an axle (not shown), and a brake 53 is mounted to the yoke 51 for selectively engaging the wheel 49 to prevent rotation thereof. The yoke 51 includes a vertical, upwardly open recess 55 which receives a castor mounting adapter 57 therein. The adapter 57 comprises a pin 59 (FIG. 3) partially received in the recess 55, and a coupling 61 receiving the upper portion of the pin 59. The coupling 61 includes an annular bottom flange 63, a coaxial cylindrical extension 65 upstanding from the flange 63, and a coaxial blind bore 67 for receiving the pin 59 and opening downwardly through the flange 63 and extension 65. Angularly spaced ribs 69 extend axially upwardly from flange 63 throughout the length of the cylindrical extension 65 and project radially outwardly thereof. The flange 63 and adjacent lower portions of ribs 69 define a diameter which substantially equals the inner diameter of the recess 44 in the glide 22 so as to effect a snug fit when the coupling 61 is inserted into the recess 44. The ribs 69, above the stop or shoulder 69A, are of smaller diameter so as to snugly fit within the passage 35.

Figure 3:
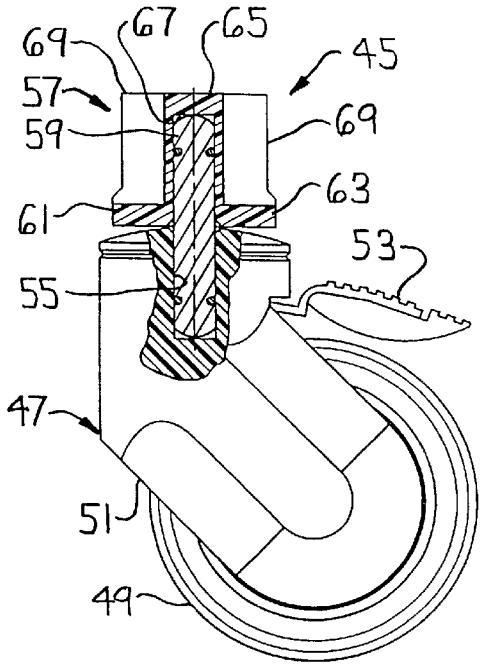
FIG. 3 is a partial cut away view of a castor assembly.
Figure 6:
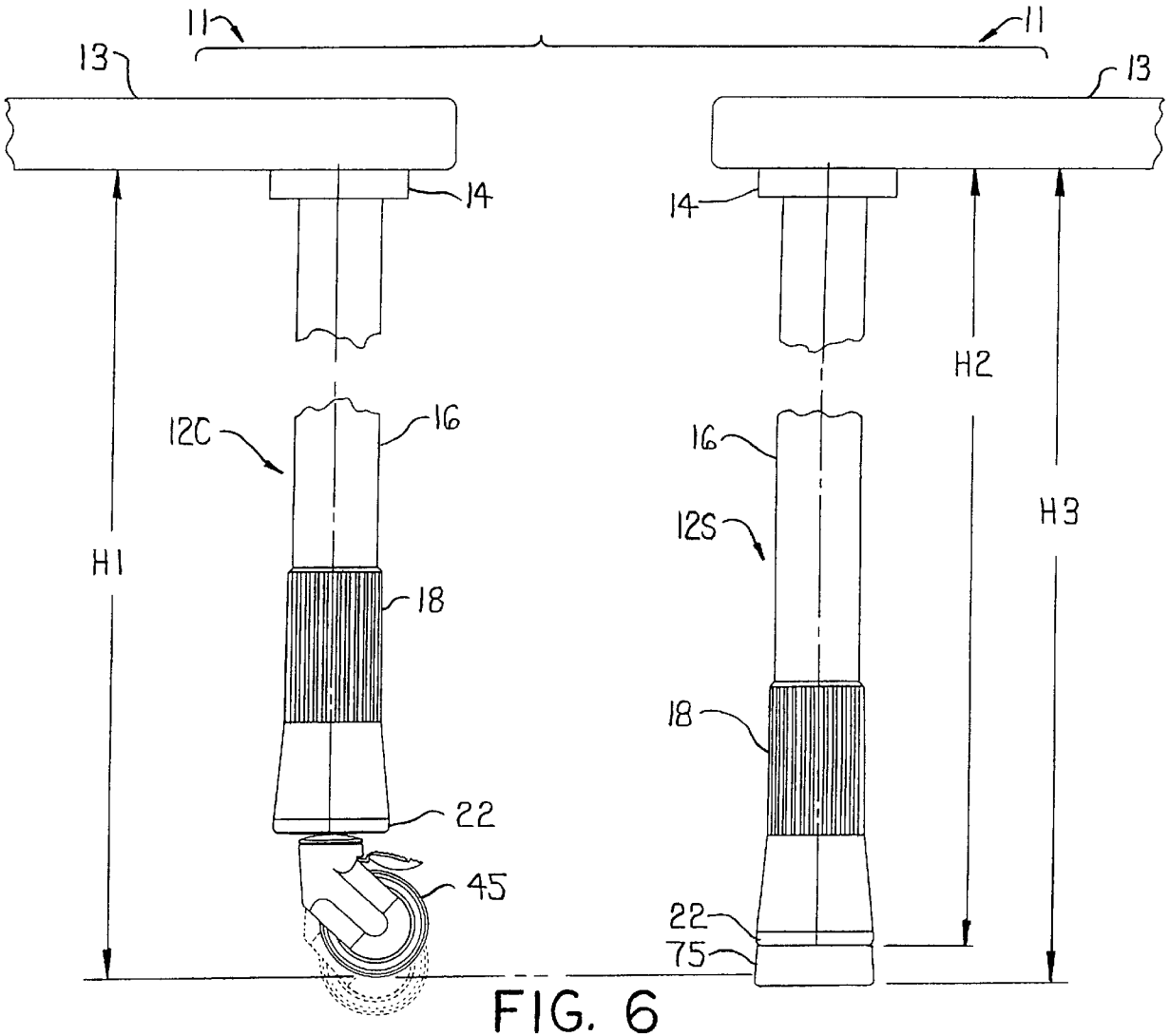
FIG. 6 is a view showing two legs, one with a castor assembly and the other with a spacer.

A modified assembly of the leg structure 12 includes addition of the castor assembly 45 to create a castored leg 12C (FIG. 6). The coupling 61 is inserted into the recess 44 of the adjustable glide 22. The ribs 69 snugly contact the recess 44 and passage 35 to fix the coupling 61 therein. The pin 59 as carried by the yoke of the castor 47 is then inserted into the bore 67 so that the upper surface of yoke 51 substantially abuts the flange 61 as shown in FIG. 3, thereby enabling the castor to abut the pin 59. When assembled, the minimum height (axial length) of the leg structure 12C is increased by the height of the castor 45 extending beneath the glide 22, resulting in an overall minimum height H1 of the castored leg.

The above described assemblies of the leg structures 12, 12C are known. One example of this type of table leg is sold by Plako, GmbH. of Ennepetal, Germany. Unfortunately, these known leg arrangements create a problem with regard to their respective heights which prevent the use of castor-free leg structures 12 and castored leg structures 12C on the same table, or on adjacent tables of the same height. More specifically, the maximum height H2 of a castor-free table leg structure 12 is less than the overall minimum height H1 of a castored table leg structure 12C (FIG. 6). Therefore, adjacent tables which are respectively supported by castor-free leg structures 12 and castored leg structures 12C can not be adjusted to define a contiguous planar worksurface. Castor-free and castored leg structures 12 and 12C also can not be mounted to a single table top because such an arrangement would permanently slope the table top.

Figure 5:
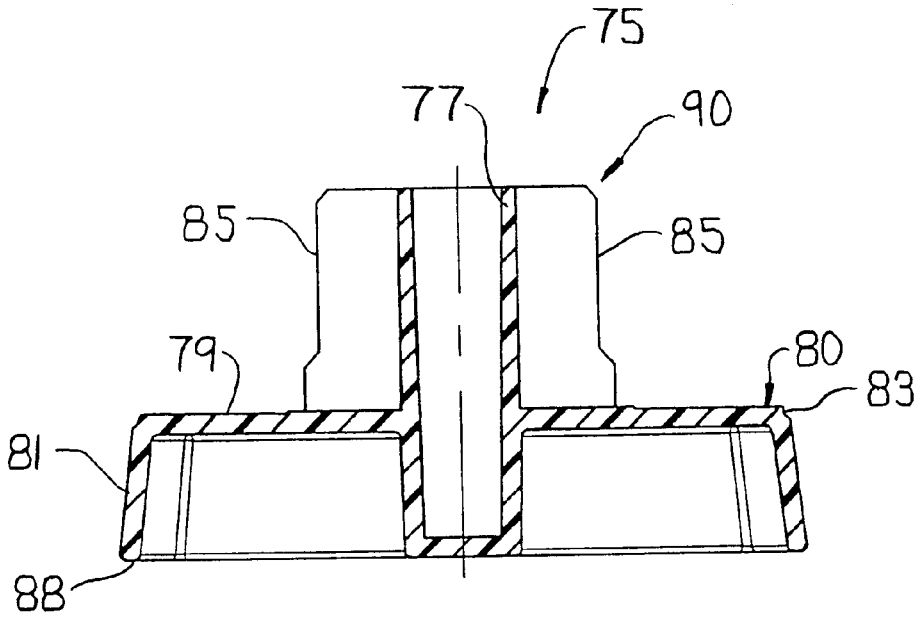
FIG. 5 is a cross sectional view of the spacer of the present invention.

To solve the problems created by the conventional table legs, the leg structure 12 of the present invention further includes a separate spacer 75 (FIGS. 4 and 5) which can be easily but removably attached to the bottom of glide 22 so as to extend the length (i.e. height) of the leg arrangement 12 when a castor assembly is not mounted thereon.

The spacer 75 includes an elongate cylindrical hub 77 which, adjacent its lower end, is rigidly joined to a surrounding annular foot part 80. This foot part 80, in the illustrated embodiment, includes a top wall 79 which projects radially outwardly from hub 77 and, at its outer annular edge 83, is fixed to a downwardly projecting annular skirt 81. The skirt 81 is of significant axial length (i.e. height), having a minimum height of about one-half inch and preferably a height of about three-fourth inch to about one inch. The skirt 81 has a diameter which approximately equals, or is of similar magnitude to the diameter of the glide foot 21. The lower free edge 88 of skirt 81 defines a floor engaging surface. The hub 77 also preferably projects downwardly so that its lower end surface is substantially coplanar with edge 88. A plurality of ribs 85 preferably extend radially between the hub 77 and skirt 81 to reinforce the foot part 80.

The upper part 90 of spacer 75 disposed above the foot part 80 defines a coupling part which generally corresponds to the coupling 61 described above. That is, the coupling part of spacer 75 is cantilevered coaxially upward from foot part 80 and includes a plurality of angularly spaced ribs 85 which extend axially along the upper portion of hub 77 and project radially outwardly thereof. The ribs 85 have a stepped configuration like ribs 69 so as to snugly fit within the stepped recess 44 and into the lower end of passage 36.

The spacer 75 is preferably molded in one piece of a plastics material, and the hub 77 has a blind bore formed coaxially thereof and opening outwardly through the upper end thereof.

To assemble the modified leg structure 12, the spacer 75 is mounted to the lower end of the adjustable glide 22 to create a castor-free leg 12S with spacer (FIGS. 4 and 6). The coupling part 90 of the spacer 75 is inserted into the recess 44 of the adjustable glide 22 so that the ribs 85 snugly fit against the interior of the glide 22 thereby fixing the spacer 75 into the glide. The top wall 79 of spacer foot part 80 abuts the lower face 21A of the foot part 21 in the fully inserted position of the spacer 75, whereat the skirt 81 defines the height added to the leg structure 12 (FIG. 1). That is, the leg structure 12S with spacer 75 (FIG. 6) has a height H3 which is greater than the height H2 of the leg structure 12 without the spacer. Moreover, the leg structure 12S with spacer 75 has a maximum height H3 which at least equals and preferably is greater than the minimum height H1 of the castored leg structure 12C.

In use, a table supported by the castor-free leg structures 12 (FIG. 1) can be adjusted between minimum and maximum heights so as to improve the ergonomics thereof. If it is desired to use two tables next to each other in order to enlarge the available worksurface, then another similar table supported by castor-free leg structures 12 is positioned adjacent the first table and the heights of the adjacent tables are adjusted to provide a substantially contiguous planar worksurface.

However, it may be preferable to provide one of the tables with castored leg structures 12C. Unfortunately, the maximum height H2 of the castor-free leg structures 12 is less than the minimum height H1 of the castored leg structures 12C. It follows that the tables can not be horizontally aligned and the worksurfaces of these adjacent tables is disjointed and nonplanar. This problem is overcome by adding the spacer 75 to the leg structures 12 (i.e. without a castor) to create the leg structure 12S (FIG. 6) having a maximum height H3 which is greater than the minimum height H1 of the castored leg structure 12C. As a result, tables respectively supported by castored leg structures 12C and castor-free leg structures 12S with spacers can horizontally align the worksurfaces to define a contiguous planar worksurface.

Further, a table with castored legs 12C can have the casters removed and spacers 75 retrofitted onto the legs so as to maintain the table at the same or similar height. The spacers 75 can also be easily retrofitted on, or removed from, the legs 12 to provide a greater variation in selectable table heights when desired.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. In combination, first and second tables positioned adjacent each other and defining substantially horizontal worksurfaces and respectively vertically supported by pluralities of first and second leg assemblies above a floor, said first and second leg assemblies each including a vertically elongate leg member and a height adjustable glide movably mounted at a lower end of said leg member and projecting downwardly therefrom for contact with a floor, said glide being adjustable between first and second positions defining first minimum and maximum heights of said leg assemblies, castors being respectively mounted to said glides on said first leg assemblies so as to define a second minimum height of said first leg assemblies, said second minimum height being greater than said first maximum height, and spacers respectively removably mounted to lower free ends of said second leg assemblies to define a second maximum height of said second leg assemblies, each said spacer including an elongate axial cylinder, a disk-shaped flange extending outwardly of said cylinder, and a skirt cantilevered from an outer periphery of said flange, a free edge of said skirt and a lower end of said cylinder being adapted to contact the floor, said skirt defining the height of said spacer which is added to said second leg assemblies so as to determine said second maximum height, said second maximum height being greater than or equal to said second minimum height, and said first and second leg assemblies being adjusted to a same height which at least equals said second minimum height so as to horizontally align the worksurfaces defined by said first and second tables.

2. The combination according to claim 1, wherein said leg members each include a main elongate leg portion having a recess at the lower end thereof, a bushing fixed in said recess and having a through passage in which said adjustable glide is received, said bushing and said glide including intermeshed threads so that said glide can be rotated relative to said bushing to determine the height of said leg assembly, said glide including a downwardly-opening recess for respectively receiving one of said castor and said spacer.

3. The combination according to claim 2, wherein said spacer includes radially outwardly extending ribs on said cylinder above said flange, said ribs snugly engaging within said recess in said glide in a said second leg assembly.

4. The combination according to claim 3, wherein said castor includes an adapter for fixing said castor to said glide, said adapter including an elongate axial cylinder and radially outwardly extending ribs for snugly engaging within said recess in said glide in a said first leg assembly, said ribs on both said adapter and said spacer being identical to each other so that said adapter and spacer can be mounted in identical recesses in respective said glides.

5. The combination according to claim 1 wherein said glides of said first and second leg assemblies each define a downwardly opening recess therein, said recesses being identical to one another to permit interchangeable mounting of one of said castor and said spacer therein.

6. In combination, first and second tables positioned adjacent each other and defining substantially horizontal worksurfaces and respectively vertically supported by pluralities of first and second leg assemblies above a floor, said first and second leg assemblies each including a vertically elongate leg member and a height adjustable glide movably mounted at a lower end of said leg member and projecting downwardly therefrom for contact with a floor, said glide being adjustable between first and second positions defining first minimum and maximum heights of said leg assemblies, castors being respectively mounted to said glides on said first leg assemblies so as to define a second minimum height of said first leg assemblies, said second minimum height being greater than said first maximum height, and spacers respectively removably mounted to lower free ends of said second leg assemblies, said spacers each including a coupling part and a foot part joined together, said coupling parts being removably mounted to the respective said glides, and said foot parts extending below the respective said glides to add height to said second leg assemblies and define a second maximum height of said second leg assemblies, said second maximum height being greater than or equal to said second minimum height, and said first and second leg assemblies being adjusted to a same height which at least equals said second minimum height so as to horizontally align the worksurfaces defined by said first and second tables.

7. The combination of claim 6 wherein each said spacer includes a generally cylindrical hub rigidly joined to the respective foot part, an upper portion of said hub including a plurality of ribs which extend axially along said hub and project radially outwardly therefrom, said ribs and upper portion together defining said coupling part which engages in a downwardly opening recess defined in said glide of the respective second leg assembly, said foot part including a top wall which projects radially outwardly from a lower portion of said hub and has an outer annular edge, and an annular skirt which projects downwardly from said outer edge and has a lower free edge which engages the floor.

8. The combination of claim 7 wherein each said castor includes a wheel assembly and an adaptor mounted on an upper portion thereof, said adaptor including a generally cylindrical hub and a plurality of ribs which extend axially along said adaptor hub and project radially outwardly therefrom, said adaptor hub and the respective ribs engaging within a downwardly opening recess defined in said glide of the respective first leg assembly.

9. The table according to claim 8 wherein said recesses defined in said glides of said first and second leg assemblies are identical to one another, and said coupling parts and said adaptors have similar configurations to allow interchangeable mounting of one of said castor and said spacer on a selected leg assembly.

10. A table leg for supporting a table top, said table leg comprising:

an elongate main leg connectable to an underside of a table top for supporting same vertically above a floor;

an elongate bushing received in and fixed to said main leg adjacent a lower end of said main leg, said bushing including an axial through passage and an outwardly extending flange at a lower end thereof, said flange contacting the lower end of said main leg, said passage being internally threaded adjacent an upper end thereof;

an elongate adjustable glide received in said passage, said glide including external threads on an upper portion thereof and a radially outwardly extending flange at a lower end thereof, said glide further including a downwardly opening recess in the lower end thereof, said external and internal threads being intermeshed to axially fix said glide to said bushing and to permit rotation of said glide so as to determine maximum and minimum heights of said leg; and a spacer having a main body of significant height and a reduced diameter coaxial stem, said stem being removably fixed in said recess of said glide, said main body extending downwardly from said glide to increase the maximum height of said leg by the height of said main body;

whereby said table leg is adapted to receive either a said castor or a said spacer so that a pair of table tops respectively supported by said table leg with said castor and said table leg with said spacer are adjustable to the same height above a floor.

11. The table leg according to claim 10, wherein said main body includes a disk-shaped flange extending radially outwardly of said stem and a skirt cantilevered downwardly from an outer periphery of said disk-shaped flange, a free end of said skirt being adapted to contact the floor and support said leg.

12. The table leg according to claim 11, wherein said stem extends below said disk-shaped flange and a lower end of said stem is adapted to contact the floor and support said leg, and said stem lower end and skirt free end are substantially coplanar with one another.

* * * * *